US005533642A

United States Patent [19]

Lafond et al.

[11] Patent Number: 5,533,642

[45] Date of Patent: Jul. 9, 1996

[54] BIOLOGICAL SPECIMEN CASSETTE

[75] Inventors: André Lafond, St-Hilaire; Gérard Laliberte, Beloeil, both of Canada

[73] Assignee: 2986647 Canada Inc., St. Hilaire, Canada

[21] Appl. No.: 260,139

[22] Filed: Jun. 15, 1994

[51] Int. Cl.[6] ..... B65D 45/16

[52] U.S. Cl. ..... 220/326; 220/333; 220/338; 220/367.1; 220/913; 220/337

[58] Field of Search ..... 220/4.22, 212, 220/212.5, 263, 324, 326, 329, 333, 335, 337, 338, 367.1, 913

[56] References Cited

U.S. PATENT DOCUMENTS

| | | | |
|---|---|---|---|
| 3,710,761 | 1/1973 | Gregory | 220/4.22 X |
| 4,220,252 | 9/1980 | Beall et al. | 220/307 |
| 4,421,246 | 12/1983 | Schultz et al. | 220/307 |
| 4,549,670 | 10/1985 | Trendler | 220/338 |
| 4,997,100 | 3/1991 | Dudek | 220/306 |
| 5,127,537 | 7/1992 | Graham | 220/339 |
| 5,205,413 | 4/1993 | Cautereels et al. | 220/4.22 X |

*Primary Examiner*—Allan N. Shoap
*Assistant Examiner*—Stephen Cronin
*Attorney, Agent, or Firm*—Quarles & Brady

[57] ABSTRACT

A biological specimen cassette comprising a base and a lid wherein the lid has two pivotal connections, one at the front wall, the other at the rear wall of the base. The first pivotal connection allows a specimen to be placed in the base while the second pivotal connection allows the lid to be opened for removal of the specimen. Both pivotal connections serve to secure the lid to the base during storage of the specimen, but allow subsequent easy detachment of the lid from the base.

10 Claims, 3 Drawing Sheets

BIOLOGICAL SPECIMEN CASSETTE

FIELD OF THE INVENTION

The present invention relates to a biological specimen cassette and, more particularly, to a cassette suitable for securing a biological tissue specimen in a fluid permeable manner so that the tissue can be subsequently sliced into thin sections on a microtome for subsequent microscopic examination.

BACKGROUND OF THE INVENTION

Cassettes for processing biological specimens are well known. For example, U.S. Pat. No. 4,220,252 issued Sep. 2, 1990 to Beall et al. describes such a container wherein a perforated receptacle is attached through a frangible hinge portion to a perforated cover. When the cover is rotated about the hinge to mate against the receptacle, the detent means on the cover become inter-engageable with abutment means on the receptacle to hold the cover and receptacle in removable mating relationship.

U.S. Pat. No. 4,421,246 issued Dec. 20, 1983 to Schultz et al. describes a tissue cassette having an open top perforated base adapted to receive a tissue specimen and a perforated lid adapted to cover the base. In the open position, the base and lid are secured together through one or more gates which will break when flexed.

U.S. Pat. No. 4,997,100 issued Mar. 5, 1991 to Dudek describes a unitary biological processing apparatus wherein a perforated receptacle with two arc-shaped abutments and a third hook-shaped abutment is attached through a frangible hinge portion to a perforated lid with two arc-shaped detents at the two edges of the lid.

All of the above cassettes have frangible portions which must be broken once the specimen is placed in the base so that the lid may be secured to the base. The advantage of having a hinge portion is that the lid remains connected to the base until use is required to retain a specimen. However, some disadvantages exist. For example, in some cases, the frangible portions are too thin and will break before the lid is secured in place. In other cases, the frangible portions are too thick and will not fold easily.

Also, on most cassettes having a lid with a tab, the latter extends over the front angled face of the base, thus limiting the area on which data relating to the specimen may be inscribed or read.

OBJECTS AND STATEMENT OF THE INVENTION

It is an object of the present invention to overcome the above described problems of presently used cassettes.

This is achieved by providing a cassette with two separate parts, a base and a lid. These parts are so constructed that they enable two distinct pivotal movements of the lid relative to the base. The cassette is supplied to the user with the lid pivotally clipped to the back of the base in a semi-closed position. The first pivotal movement is performed when a specimen is placed in the base. The second pivotal movement of the lid is achieved after the cassette has been closed and when it is needed to remove the specimen from the base.

The present invention therefore relates to a biological specimen cassette which comprises a base having a perforated bottom wall, opposite side walls, front and rear walls, the rear wall having first lid connecting means, the side walls having second lid connecting means adjacent the front wall. The cassette also includes a lid having a perforated top face having an integral tab formed at one end of the top face; the lid defines first base engaging means extending from and below the one end of the top face for engaging the first lid connecting means of the rear wall and providing first pivotal movement of the lid about the rear wall to open the lid so that a specimen may be placed in the base. The lid defines second base engaging means at an opposite end thereof for engaging the second lid connecting means of the base to secure, in a first instance, the lid to the base after a specimen is placed therein and, in a second instance, to provide a second pivotal movement of the lid relative to the base for subsequent removal of the specimen from the base.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

FIG. 1, is a side elevation of the cassette being opened for specimen removal;

DESCRIPTION OF A PREFERRED EMBODIMENT

Figure 1:
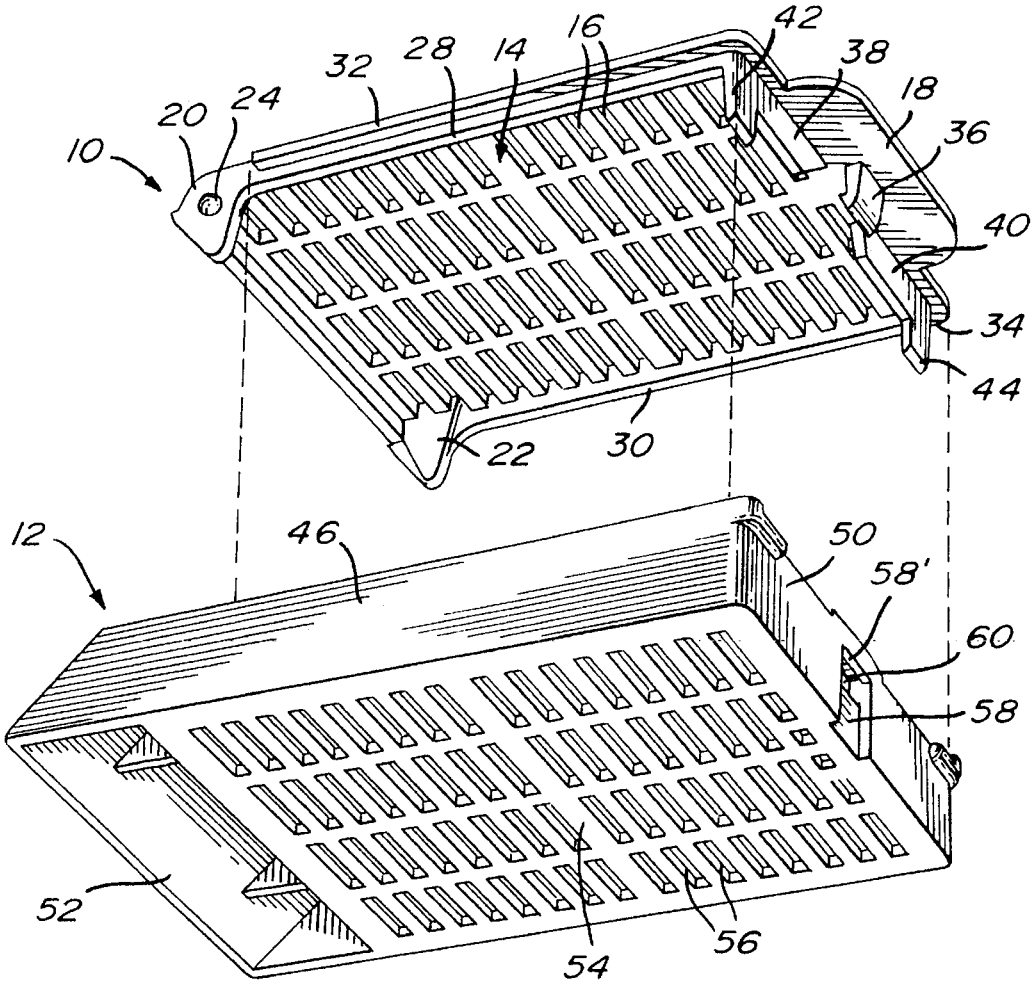
FIG. 1 is a bottom perspective view of the base and lid forming the biological specimen cassette of the present invention.

Referring to FIG. 1, the cassette of the present invention consists of a lid 10 and a base 12.

The lid 10 consists of a body having a rectangular major portion 14 displaying a series of small rectangular openings 16. One end of the lid displays an integral flap 18 extending in the same plane as that of the major portion 14 while the opposite end thereof displays a pair of side wings 20 and 22, each displaying, on its outer face, a semi-spherical protuberance 24, 26 (see also FIG. 7). The side wings 20 and 22 are front extensions of the two opposite narrow side walls 28 and 30, longitudinally extending inwardly of the side edges 32 and 34 of the major position 14. Below the flap 18, an integral locking finger 36 extends centrally in front of a gap separating a pair of downwardly extending rear walls 38 and 40, each having a leg 42, 44, respectively, at the rear corners of the lid.

The base 12 defines a rectangular body having opposite sidewalls 46 and 48, a rear wall 50, a front wall 52 and a bottom wall 54. The front wall 50 is angled to display, on the outer face thereof, identification data inscribed thereon pertaining to a specimen which is to be placed on the bottom wall 54. The latter is perforated with a series of rectangular openings 56. Each side wall has, in its inner face, adjacent the front wall, a semi-spherical recess 47, 49 corresponding substantially in shape to the semi-spherical protuberance 24, 26 of the lid. The rear wall 50 includes a rectangular recessed area 58 with an opening 60 allowing communication with a rectangular internal cavity 62.

Figure 2:
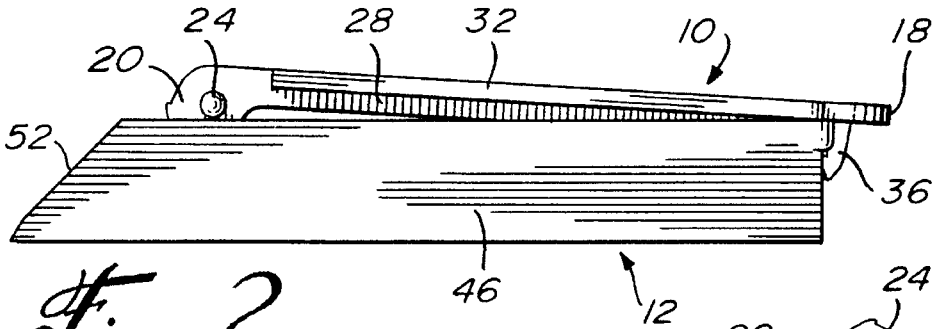
FIG. 2 is a side elevation of the cassette assembled prior to receiving a biological specimen.

FIG. 2 illustrates the cassette in the condition that it is delivered prior to receiving a specimen. The lid 10 is connected to the base 12 at its rear wall 50 with the pair of legs 42 and 44 extending within the base rear wall and with the finger 36 extending outside the base rear wall in front of the recessed area 58.

Figure 3:
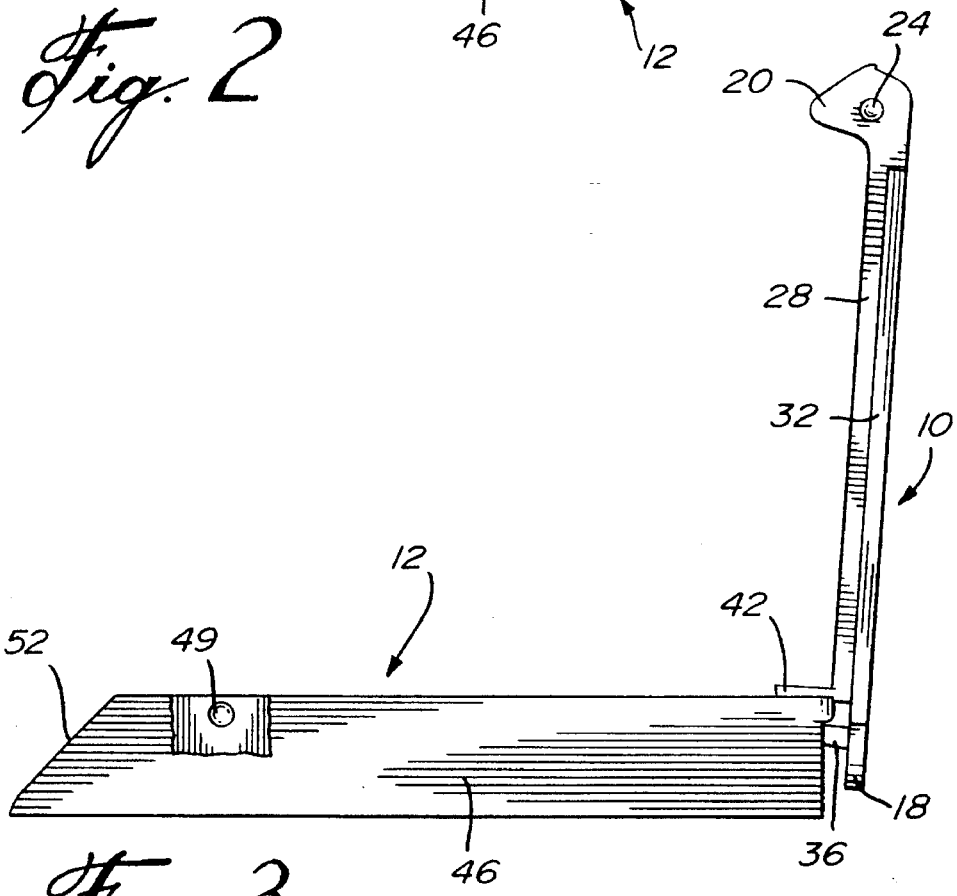
FIG. 3 is a side elevation showing the lid in the open position to receive a biological specimen.

FIG. 3 illustrates the lid in the open position ready to receive a specimen on the bottom wall of the base. The connection of the lid to the base at the rear end of the cassette is achieved through a snap-in engagement of the rear wall 50 being engaged between side walls 38, 40 with their legs 42, 44 on one side and finger 36 on the other side. The separation of the finger hook portion 36' from a plane including walls 38 and 40 is slightly less than the width of the rear wall 50 over the recessed area 58 so that, as the lid is pressed downwardly onto the base rear wall, the finger is slightly flexed outwards to thereafter snap back in the recessed area 58 under the recess top edge 58'. In the open position shown in FIG. 3, finger 36 extends horizontally through the opening 60 of the recess.

Figure 4:
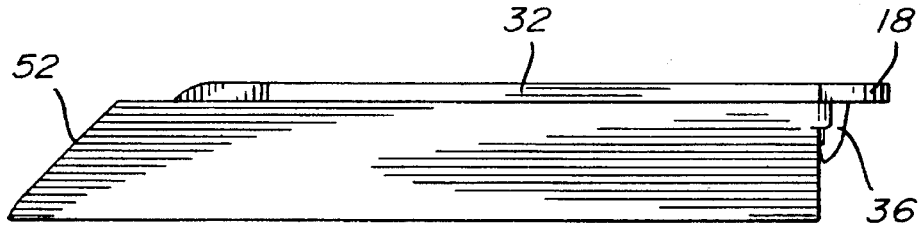
FIG. 4 is a side elevation showing the lid in the closed position.

After a specimen is placed on the bottom wall of the base, the lid is closed as shown in FIG. 4 with side edges 32 and 34 resting on the upper edges of the side walls 46 and 48. The lid is secured in this closed position through another snap-in engagement by forcing the semi-circular protuberances 24 and 26 along the inner faces of the side walls into their corresponding semi-circular recesses of 47 and 49.

In the closed position, the flap 18 lies over the rear wall, remote from the front wall 52 so that, in this position it does not hinder the inscribing of data on the front wall.

Figure 5:
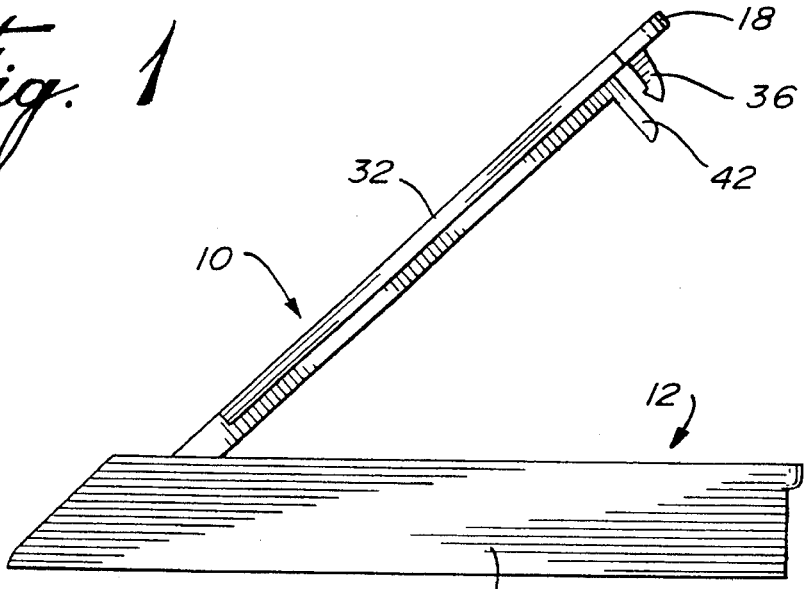
FIG. 5, which is shown on the sheet illustrating
Figure 6:
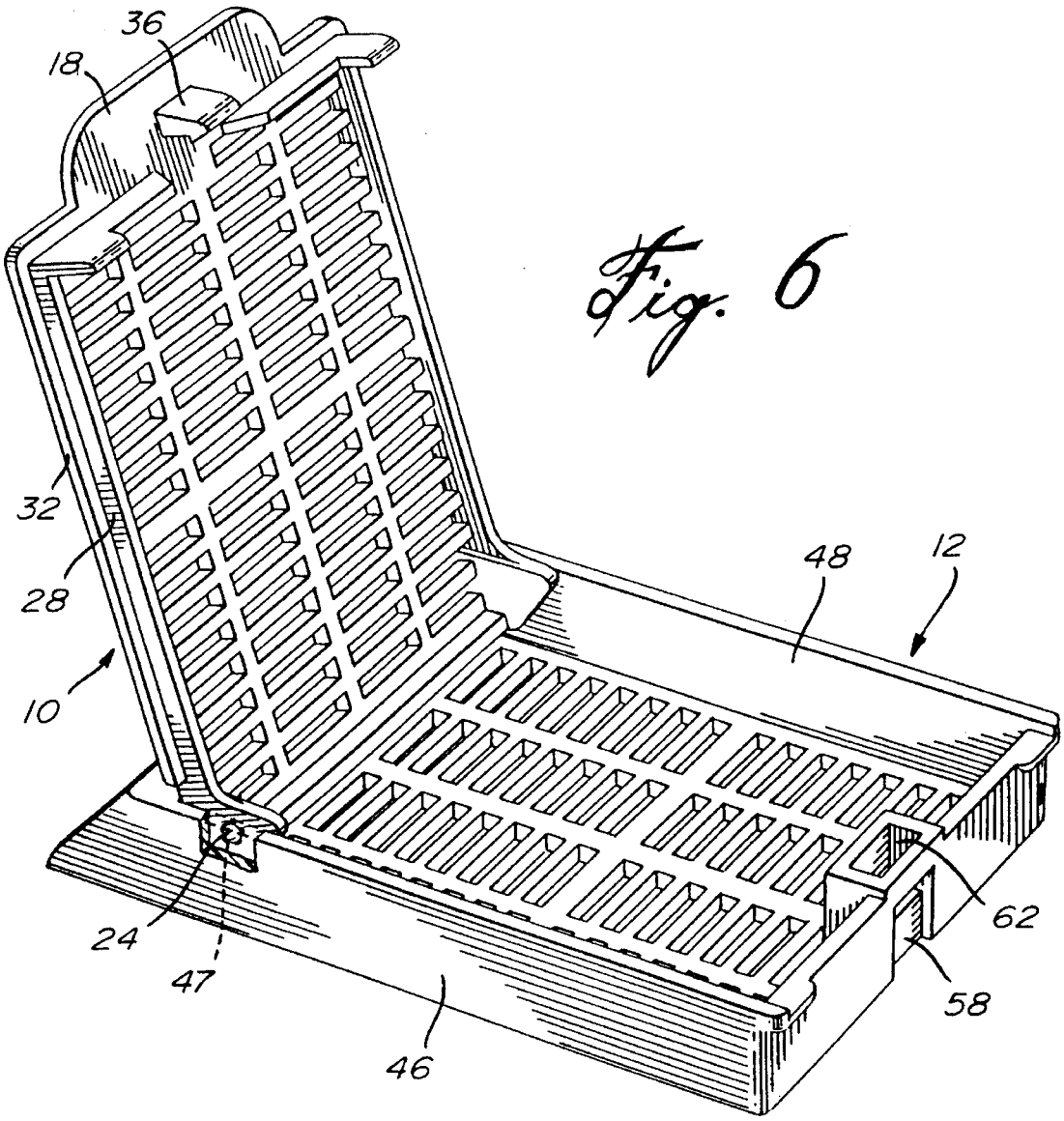
FIG. 6 is a top perspective view showing the lid in the opened position.
Figure 7:
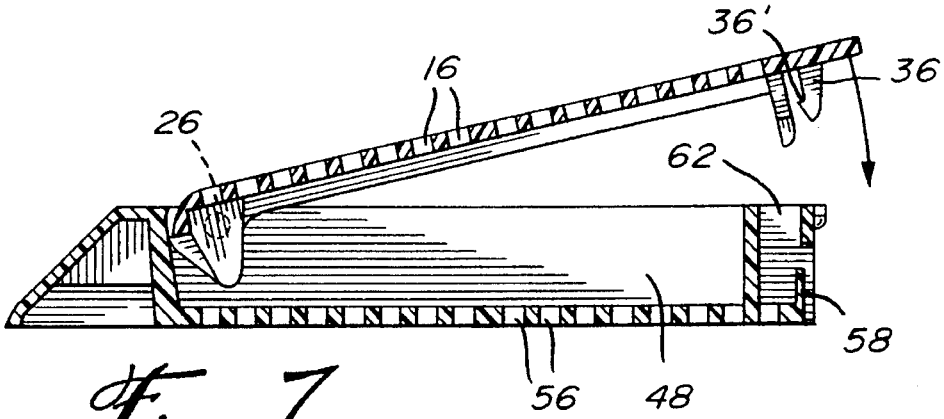
FIG. 7 is a cross sectional view of the cassette shown in FIG. 5 being closed.

When it is desired to remove the specimen from the cassette, the lid is pivoted in the manner shown in FIGS. 5, 6 and 7 about the axis of the semi-spherical protuberances 24 and 26. The disengagement of the lid from the position shown in FIG. 4 is accomplished by lifting the tab 18 at the back of the cassette with the forefinger while depressing the center of the lid with the thumb, thus releasing the locking finger and lifting the lid.

To remove the cover, the lid is further pivoted frontwardly over the front wall 52, forcing the semi-circular protuberances out of their semi-circular recesses in the side walls of the base.

The cassette is molded from a high density polymer so that it may keep the specimens safely submerged in solvent and be totally resistant to the chemical action of histological solvents. The efficient flow-through openings in the lid and base maximize fluid exchange and insure proper drainage. The lid may be opened and closed as often as necessary and it relocks securely without danger of specimen loss. Hence, the cassette must be made of a deformable plastics material so that the snap-in as well as the snap-out engagements at the front and rear walls of the cassette be properly carried out.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A biological specimen cassette comprising:

a base having a perforated bottom wall, opposite side walls, front and rear walls; said rear wall having first lid connecting means; said side walls having second lid connecting means adjacent said front wall; and a lid having a perforated top face, said top face including an integral tab formed at one end thereof; said lid defining first base engaging means extending from and below said one end of said top face for engaging said first lid connecting means of said rear wall and providing first pivotal movement of said lid relative to said base to open said lid so that a specimen may be placed in said base; said lid defining second base engaging means at an opposite end thereof for engaging said second lid connecting means of said base to secure, in a first instance, the lid to the base after a specimen is placed therein and, in a second instance, to provide a second pivotal movement of said lid relative to said base for subsequent removal of the specimen from said base, said second base engaging means including downwardly extending integral portions at opposite sides of said lid; said portions extending within said base when said lid is secured to said base in said first instance.

2. A cassette as defined in claim 1, wherein said portions include side projections engaging correspondingly shaped recesses in said side walls of said base.

3. A cassette as defined in claim 2, wherein said side projections are forcingly engaged in said recesses.

4. A cassette as defined in claim 1, wherein said first lid connecting means consist of finger receiving means in said rear wall and wherein said first base engaging means consist of a finger and a pair of guides; said finger extending outside said rear wall and engaging said finger receiving means; said guides extending within said base.

5. A cassette as defined in claim 4, wherein said finger receiving means consists of an opening in said rear wall and wherein said finger includes a hook portion snappily engaging an edge in said opening.

6. A cassette as defined in claim 5, wherein said finger is integral with and extends below said tab of said lid.

7. A cassette as defined in claim 1, wherein said front wall is angled to display inscribed data related to said specimen.

8. A cassette as defined in claim 1, wherein said base and said lid are made of deformable plastics material.

9. A biological specimen cassette comprising:

a base having a perforated bottom wall, opposite side walls, front and rear walls; said rear wall having first lid connecting means; said side walls having second lid connecting means adjacent said front wall; and a lid having a perforated top face, said top face including an integral tab formed at one end thereof; said lid defining first base engaging means extending from and below said one end of said top face for engaging said first lid connecting means of said rear wall and providing a first pivotal connection of said lid relative to said base to open said lid so that a specimen may be placed in said base; said lid defining second base engaging means at an opposite end thereof for engaging said second lid connecting means of said base to secure, in a first instance, the lid to the base after a specimen is placed therein and, in a second instance, to provide a second pivotal movement of said lid relative to said base for subsequent removal of the specimen from said base, and, in a third instance in which said lid and base are engaged to provide said first pivotal connection, to rest on said base in a disengaged position in which said second base engaging means supports said opposite end above the position of said opposite end in said first instance so that said opposite end may be grasped by a user to pivot said lid up by said first pivotal connection to place a specimen in said base.

10. A biological specimen cassette as defined in claim 9, wherein said first base engaging means is releasable so as to pivot said lid open from said one end, and re-engageable so as to re-secure said one end closed.

* * * * *